US005989799A

United States Patent [19]

Verbeeck et al.

[11] Patent Number: 5,989,799

[45] Date of Patent: Nov. 23, 1999

[54] RADIOGRAPHIC UV/BLUE INTENSIFYING SCREEN-FILM COMBINATION

[75] Inventors: Ann Verbeeck, Begijnendijk; Peter Verrept, Avelgem; Paul Callant, Edegem; Koenraad Caron, Wilrijk, all of Belgium

[73] Assignee: Agfa-Gevaert. N.V., Mortsel, Belgium

[21] Appl. No.: 09/099,325

[22] Filed: Jun. 18, 1998

[30] Foreign Application Priority Data

Jul. 11, 1997 [EP] European Pat. Off. ..... 97202169

[51] Int. Cl.[6] ..... G03C 1/035; G03C 1/10; G03C 5/17

[52] U.S. Cl. ..... 430/567; 430/591; 430/966; 250/486.1; 252/301.4 R

[58] Field of Search ..... 430/567, 569, 430/966, 967, 591; 250/486.1; 252/301.4 R

[56] References Cited

U.S. PATENT DOCUMENTS

| | | | |
|---|---|---|---|
| 2,080,050 | 5/1937 | Kendall | 430/591 |
| 4,225,653 | 9/1980 | Brixner | 428/690 |
| 5,601,969 | 2/1997 | Verbeeck | 430/569 |

FOREIGN PATENT DOCUMENTS

| | | | |
|---|---|---|---|
| 0 770 909 A1 | 5/1997 | European Pat. Off. | G03C 1/46 |
| WO 93/11458 | 6/1993 | WIPO | G03C 5/17 |

*Primary Examiner*—Mark F. Huff
*Attorney, Agent, or Firm*—Breiner & Breiner

[57] ABSTRACT

A radiographic screen/film combination or system has been provided comprising a duplitized film sandwiched between a pair of supporting or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 380 nm, as e.g. a niobium and gadolinium doped, monoclinic M, yttriumtantalate (MYT) phosphor corresponding to formula I $$YTaO_4:Gd:Nb \quad (I),$$

ii) said film comprises {111} tabular silver halide grains rich in silver chloride, spectrally sensitive to irradiation in the said wavelength range shorter than 380 nm by the presence of at least one azacyanine dye as a spectral sensitizer.

10 Claims, No Drawings

RADIOGRAPHIC UV/BLUE INTENSIFYING SCREEN-FILM COMBINATION

DESCRIPTION

1. Field of the Invention

This invention relates to a screen-film combination of a radiographic intensifying phosphor screen and a light-sensitive silver halide photographic material comprising tabular grains rich in silver chloride.

2. Background of the Invention

Combinations of intensifying screens provided with luminescent phosphors and light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized materials as e.g. in chest imaging).

It is clear that in order to get an image to be examined on the film that after said exposure the film material is processed in a wet processing cycle, requiring appropriate chemistry. A normal processing cycle, whether or not performed in an automatic processing machine, is following the steps of developing, fixing, rinsing an drying. The more film material is passing in the corresponding processing solutions of developer and fixer, the more both of them become exhausted. In order to overcome that problem replenishing is required.

As nowadays ecology becomes more and more important it is recommended to reduce amounts of processing chemicals (developer, fixer and corresponding replenishers) to a considerable extent in order to reduce waste chemicals. Within the same context it is recommended to reduce wash out or rinsing out of chemical compounds coated in the film material as e.g. wash out in the processing of sensitizing dyes or filter dyes present in hydrophilic layers of the said film material thereby causing deposition of dirt on the walls and rollers of the processing tanks.

Especially when the light-sensitive silver halide emulsion crystals have been made sensitive to visible light as e.g. to blue or green light emitted from blue light or green light emitting intensifying phosphor screens the corresponding spectral sensitizers make arise the problem of insufficient removal from the film material, thereby causing residual color increase minimum density and deviate image tone from the desired outlook of the processed image. A solution therefore could be to provide screen-film combinations based on the absorption characteristics of nonspectrally sensitized silver halide emulsion crystals, wherein combination with dedicated luminescent phosphors emitting radiation covering the absorption spectrum from the said silver halide emulsions.

Reduction of waste amounts of chemicals from the developer, the fixer and especially the corresponding replenishers is advantageously attainable when in the light-sensitive silver halide photographic material use is made of emulsion crystals rich in silver chloride having a much higher solubility (and processability) than e.g. crystals rich in silver bromide (a factor of about 100). Moreover combination with the more "ecologically acceptable" ascorbic acid or derivatives thereof seems to offer an acceptable alternative.

Silver chloride emulsion crystals even when doped with minor amounts of bromide and/or iodide have an absorption spectrum which is shifted towards the ultraviolet region of the radiation spectrum if compared e.g. with silver bromide emulsion crystals. Luminescent phosphors however are not completely matching the absorption spectrum of emulsion crystals rich in silver chloride. Especially for the commercially available phosphors as e.g. $CaWO_4$ (see e.g. U.S. Pat. No. 3,300,311) emitting at 410 nm and BaFBr and $YTaO_4$.Nb (apart as in e.g. in U.S. Pat. No. 4,225,653 and EP-A 0 202 875 or in a mixture with BaFBr as in EP-A's 0 435 241 and 0 520 094) both emitting radiation at 390 nm the said radiation is not completely absorbed by the light-sensitive emulsion crystals rich in silver chloride. Therefore many attempts have been performed in order to improve the sensitization in the blue and ultra-violet regions of the electromagnetic spectrum as has e.g. been disclosed in WO 93/11458 wherein arylidene sensitizing dyes have been added to the tabular silver bromide grain emulsions.

In order to provide, after processing of the (preferably forehardened) photographic material, an image having a suitable gradation and especially high covering power and low cross-over (leading to a high sharpness) it is indeed recommended as e.g. in U.S. Pat. Nos. 4,414,304; 4,425,425 and 4,425,426 to make use of emulsion crystals or grains having a tabular habit and a high aspect ratio: tabular grain emulsions having a high aspect ratio are known to provide several advantages over more conventional spherical grains as e.g. a high covering power, a high sensitivity and a lower coating weight, which saves costs in manufacturing. Said lower coating weight is especially preferred if rapid processing applications are required, which is nowadays an ever more returning demand.

As {111} tabular grains are thermodynamically unstable during emulsion preparation crystal habit modifiers are required in order to stabilize their crystal habit during precipitation as has e.g. been disclosed in U.S. Pat. Nos. 5,061,617; 5,176,992; 5,178,998; 5,183,732; 5,185,239; 5,221,602; 5,252,452; 5,286,621; 5,298,388; 5,399,478; 5,411,852 and 5,601,969.

Optimization of sensitometric characteristics attainable with such {111} tabular grains rich in silver chloride further requires partial desorption of the stabilizing crystal habit modifier in order to admit adsorption of one or more spectral sensitizers onto specific sites of the surface of the tabular grains. Added before or during chemical ripening crystal habit modifiers and spectral sensitizers act as site directors for sensitivity specks in order to provide the required sensitometry.

Attaining the required sensitometry, even in rapid processing applications making use of minimum amounts of replenisher solutions of developer and fixer, and further getting an image having the desired contrast, high definition, covering power and image tone (the improvement of which has e.g. been demonstrated in EP-A 0 770 909, wherein use has been made of a specific multi-layer arrangement with grains having a cubic crystal habit if located farther from the support without showing disturbing residual coloration) remains an ever lasting demand.

3. OBJECTS OF THE PRESENT INVENTION

Therefore it is an object of the present invention to provide a screen-film image-forming combination or system wherein a light-sensitive silver halide photographic material is combined with an intensifying screen in order to obtain an image suitable for medical diagnosis, having a very high image quality, i.e., low fog level, high overall-contrast with an enhanced sharpness (low cross-over) after rapid processing of the said material, wherein little or no residual color or dye stain is observed in the processed material even when minimum amounts of developer, fixer and their corresponding replenishers are used in the said processing.

4. SUMMARY OF THE INVENTION

In order to reach the objects of the present invention a radiographic screen/film combination or system has been provided comprising a duplitized film sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 380 nm, as e.g. a niobium and gadolinium doped, monoclinic M, yttriumtantalate (MYT) phosphor corresponding to formula I $$YTaO_4:Gd:Nb \quad (I),$$

ii) said film comprises {111} tabular silver halide grains rich in silver chloride, spectrally sensitive to irradiation in the said wavelength range shorter than 380 nm by the presence of at least one azacyanine dye as a spectral sensitizer.

5. DETAILED DESCRIPTION OF THE INVENTION

In order to prevent residual color or dye stain after rapid processing in low replenishing conditions it is most favorable if even no antihalation dyes are used, although dye stain may also be present after processing due to the presence, in high amounts of spectral sensitizing dyes, especially in the presence of tabular grain emulsions having a large surface to volume ratio. It has now unexpectedly been observed that even in the presence of large amounts of azacyanine dyes, used as spectral sensitizing dyes for the spectral sensitization of tabular grain emulsions in the ultraviolet to blue range of the wavelength spectrum, wherein said emulsions are coated in the light-sensitive emulsion layer(s) of the silver halide photographic material used in the screen/film system of the present invention, the objects of the present invention are effectively realized.

The synthesis of aza- or diazacyanine dyes and use thereof as spectral sensitizing dyes for silver halide emulsions has been described in U.S. Pat. No. 2,307,049. Azamethine spectral sensitizers made with arylene diamine can further be found in U.S. Pat. No. 2,368,305. Both references have been filed in 1935. Many years later, in 1961 azapseudocyanines, for use as optical brighteners have been disclosed in U.S. Pat. No. 3,130,197, whereas in 1968, acid substituted azaquino-pseudo-cyanines or cyazines were disclosed in U.S. Pat. No. 3,697,282 for use as spectral sensitizers in color materials. Symmetrical and unsymmetrical quinoline azacyanine dyes can further be found in BE 812431 and in CS 1976695 respectively. Pseudo-cyanine or azamethine dyes have more recently been disclosed in U.S. Pat. No. 4,977,076. Specific azacyanine dyes suitable for use in the material of the film-screen system according to the present invention are following:

(II.1)

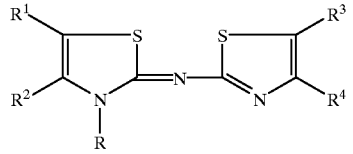

(II.2)

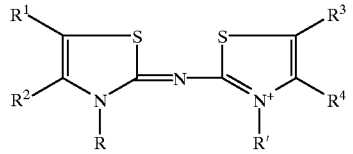

wherein each of the substituents $R^1$ –$R^4$ independently represents hydrogen, an (unsubstituted or substituted) alkyl, an (unsubstituted or substituted) aryl or an (unsubstituted or substituted) aralkyl; wherein $R^1$ and $R^2$ and/or $R^3$ and $R^4$ a form a (substituted or unsubstituted) benzoring, which, if substituted, has the same or different substituents as $R^1$–$R^4$;

wherein R represents an (substituted or unsubstituted) alkyl, aryl or aralkyl group;

wherein R' represents hydrogen, an (substituted or unsubstituted) alkyl, aryl or aralkyl group;

and wherein cations and/or anions are present as charge compensating ions.

More particularly each of R and R' independently represents $(CH_2)_nH$ or $(CH_2)_nOH$, n being an integer having a value from 1 to 4, $(CH_2)_m(SO_3^-)$, m being an integer having a value from 2 to 4, $(CH_2)_2CH(CH_3)(SO_3^-)(CH_2)_n(COO^-)$ or $(CH_2)_n(COOH)$, $(CH_2)_nCONHSO_2R$ or $(CH_2)_nCONHSO_2R'$, provided that R' may represent hydrogen as set forth hereinbefore.

In order to get neutral azacyanine structures preferred charge compensating cations are $Li^+$, $Na^+$, $K^+$, $HN^+Et_3$, wherein Et represents ethyl, whereas preferred charge compensating anions are $Cl^-$, $Br^-$, $I^-$, $^-OTos$, $^-OMes$, $CF_3SO_3^-$, wherein $^-OTos$ represents tosylate and $^-OMes$ represents mesylate.

Specific examples of azacyanine dyes are given in the formulae (II.3) to (II.13) hereinafter:

(II.3)

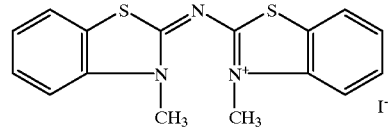

(II.4)

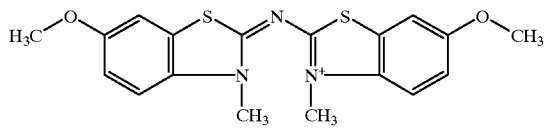

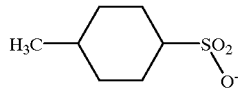

-continued (II.5)

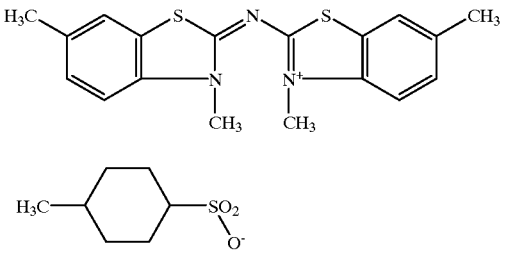

(II.6)

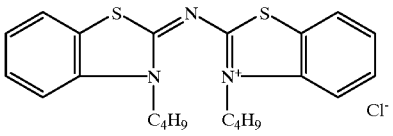

(II.7)

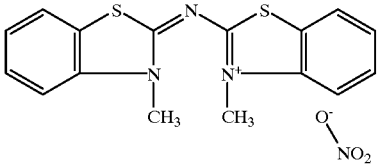

(II.8)

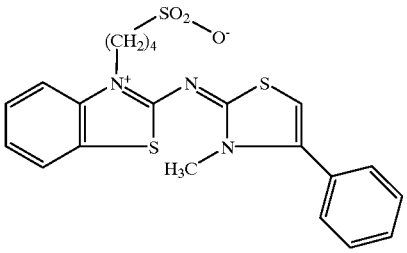

(II.9)

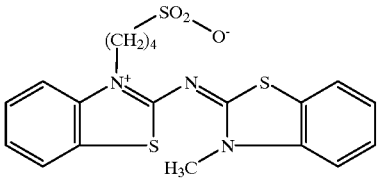

(II.10)

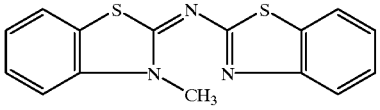

(II.11)

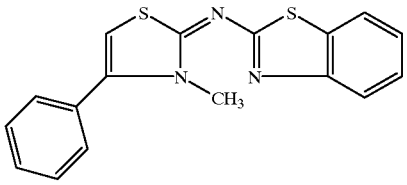

-continued (II.12)

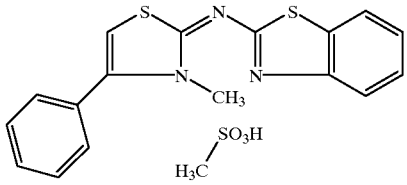

(II.13)

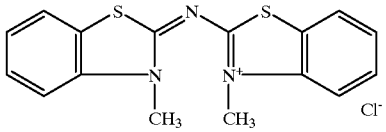

In practice the light emitted imagewise by said X-ray intensifying screen irradiates a contacting photographic silver halide emulsion layer film which after exposure is developed to form therein a silver image in conformity with the X-ray image. For use in common medical radiography (projection radiography) the X-ray film comprises a transparent film support, coated on both sides with a silver halide emulsion layer. During the X-ray irradiation said film is arranged in a cassette between two X-ray intensifying screens each of them making contact with its corresponding silver halide emulsion layer.

Phosphors suitable for use in the conventional radiographic system must have a high prompt emission of fluorescent light on X-ray irradiation and low afterglow in favour of image sharpness. The relationship between resolution and speed of X-ray intensifying screens is described e.g. in Med. Phys. 5(3), 205 (1978).

Specific intensifying screens emitting ultraviolet-blue radiation have further been disclosed in U.S. Pat. Nos. 4,225,653; 4,387,141; 4,710,637; 5,112,700; 5,173,611 and 5,432,351; in EP-A's 0,650,089; 0,658,613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and codoped with samarium as in U.S. Pat. Nos. 5,422,220 and 5,547,807 and even mixtures of tantalates and fluorohalides as in U.S. Pat. No. 5,077,145 and EP-A 0 533 234, replacing $CaWO_4$ as representative for an older well-known generation of luminescent phosphors.

In EP-A 0 820 069 particles of niobium doped, monoclinic M, yttriumtantalate phosphor and particles of an europium doped bariumfluorohalide phosphor are composing the screen.

X-ray intensifying screens according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

Examples of support materials include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably employed as the support material.

Depending on the speed class of the screens for which a synergistic effect should be attained in the relation between speed and sharpness, supports characterized by their reflectance properties, expressed as % reflectance over the wavelength range from 350 to 600 nm, are particularly used. Such supports can be highly light reflecting as e.g. polyethylene-terephthalate comprising a white pigment, e.g. $BaSO_4$, $TiO_2$, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens according to the present invention.

In most applications the phosphor layers contain sufficient binder to give structural coherence to the layer. In view of a possible phosphor recovery from worn-out screens the binder of the phosphor containing layer is preferably soluble and remains soluble after coating.

Useful binders, a non-limitative survey of which is given herein, include proteinaceous binders, e.g. gelatin, polysaccharides such as dextran, gum arabic, and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate, cellulose acetate butyrate, polyvinyl alcohol, polystyrene, polyester, etc. These and other useful binders are disclosed e.g. in U.S. Pat. Nos. 2,502,529; 2,887,379; 3,617,285; 3,300,310; 3,300,311 and 3,743,833.

A mixture of two or more of these binders may be used, e.g., a mixture of polyethyl acrylate and cellulose acetobutyrate.

The weight ratio of phosphor to binder is generally within the range of from 50:50 to 89:11, preferably from 80:20 to 89:11.

The screen according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds like IRGANOX 1010 and IRGASTAB T36 (trademarked products of CIBA-GEIGY, Basel, Switzerland), ANTIOXIDANT 330 (trademarked product of ETHYL CORP.,Richmond,USA), VANOX 2246 (trademarked product of VANDERBILT ENERGY CORP., Denver, Canada) etc, this list being non-limitative. The binder used in screens according to the present invention, with high phosphor to binder ratio, can beneficially be a polymer P having a $T_g$ £0° C., an average molecular weight ($MG_{avg}$) between 5000 and $10^7$, being soluble in ethylacetate for at least 5% by weight (% wt/wt). A self-supporting layer of 82% by volume of phosphor particles in said polymer P, having a thickness so has to comprise 100 mg of phosphor particles per $cm^2$, has an elongation to break of at least 1%. Such polymers have been disclosed in EP-A 0 758 012 and the corresponding U.S. Pat. No. 5,663,005.

The phosphor layer can be applied to the support by employing a method such as vapour deposition, sputtering and spraying but is usually applied by the following procedure.

Phosphor particles and a binder are added to an appropriate solvent as described hereinafter, and are then mixed in order to prepare a coating dispersion comprising the phosphor particles homogeneously dispersed in the binder solution. Said coating dispersion may further comprise a dispersing agent and plasticizer and filler material as described hereinafter.

The coating dispersion containing the phosphor particles and the binder is applied uniformly onto the surface of the support to form a layer of the coating dispersion. The coating procedure may proceed according to any conventional method such as doctor blade coating, dip-coating or roll coating.

For the preparation of highly abrasion resistant and chemically resistant phosphor-binder layers the binder is cured. Curing of the binder may proceed photochemically by means of UV radiation or with electron beam (EB) as described e.g. in Research Disclosure December 1977, item 16435 or proceeds purely chemically as described e.g. in U.S. Pat. No. 4,508,636. It may also be cured by moisture as described in EP-A 0 541 146. Curing may also be performed by heating.

In the preparation of the phosphor screen having a primer layer between the substrate and the fluorescent layer, the primer layer is provided on the substrate beforehand, and then the phosphor dispersion is applied to the primer layer and dried to form the fluorescent layer.

After applying the coating dispersion onto the support, the coating dispersion is then heated slowly to dryness in order to complete the formation of a phosphor layer.

In order to remove as much as possible entrapped air in the phosphor coating composition it can be subjected to an ultrasonic treatment before coating. The phosphor-binder layer (as described e.g. in U.S. Pat. No. 4,059,768) can be calendered to improve the phosphor packing density in the dried layer.

Useful solvents for the binder of the phosphor containing layer, employable in the preparation of the phosphor coating dispersion include lower alcohols such as methanol, ethanol, n-propanol and n-butanol; chlorinated hydrocarbons such as methylene chloride and ethylene chloride; ketones such as acetone, butanone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether; methyl glycol; and mixtures of the above-mentioned solvents.

Useful dispersing agents for the phosphor particles in the coating dispersion to improve the dispersibility of the phosphor particles therein, may contain a variety of additives such as a plasticizer for increasing the bonding between the binder and the phosphor particles in the phosphor layer. Examples of the dispersing agent include ionic and nonionic well-known dispersing agents or combinations thereof, e.g., DISPERSE AYD (trade name of Daniel Products Company, New Jersey, USA) GAFAC RM 610 (a tradename a polyoxyethylene (20) sorbitan monopalmitate and monolaurate marketed by General Aniline and Film Company (GAF) New York, USA, polymeric surfactants such as the acrylic graft copolymer, PHOSPHOLIPON 90 (trade name) marketed by Nattermann-Phospholipid GmbH, Köln, W. Germany, silane dispersing agents and surfactants e.g. DOW CORNING 190 (trade name) and SILANE Z6040 (trade name) marketed by Dow Corning Corporation, Midland, Mich., USA or glymo-3-glycidyloxy-propylmethoxysilane or organosulfate polysilanes, unsaturated p-aminamide salts and high molecular acid esters such as ANTI TERRA U 80 (trade name) marketed by BYK-Chemie GmbH, Wesel, W. Germany, high molecular unsaturated polyesters, etc. Dispersing agents are added in an amount of 0.05 to 10% by weight based on the phosphor.

Useful plasticizers include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; polymeric plastizers, e.g. and polyesters of polyethylene glycols with aliphatic dicarboxylic acids such as polyester of triethylene glycol with adipic acid and polyester of diethylene glycol with succinic acid.

After the formation of the fluorescent layer, a protective layer is generally provided on top of the fluorescent layer. In a prefer-red embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage by the steps of (1) coating onto said phosphor containing layer a liquid radiation-curable composition having at the coating temperature a viscosity of at least 450 mPa.s, measured with a Hoeppler viscometer, that does not penetrate for a substantial degree into the phosphor containing layer,
(2) providing an embossed structure to the coating, and
(3) curing said coating by radiation.

More details concerning preferred protective coatings with embossed surface can be found in EP-A's 0 510 753 and 0 510 754.

Assemblies providing means for reducing cross-over to less than 10% for radiation longer than 300 nm in wavelength have been described e.g. in U.S. Pat. No. 5,259,016.

For processing, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer without hardening agent;
fixing said material in a fixer, optionally without hardening agent;
rinsing and drying said material.

A normally used configuration in the processing apparatus shows the following consecutive tank units corresponding with, as consecutive solutions: developer-fixer-rinse water.

Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082.

Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

In order to reduce "sludge formation" which is favored by solubilizing agents like sulphites, present in the developer as preservatives, a particularly suitable developer solution is the one comprising a reduced amount of sulphite and ascorbic acid which acts as a main developer and antioxidant as well and which is called low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless.

If however aluminum ions are present in the fixer composition for whatever a reason, the presence of $\alpha$-ketocarboxylic acid compounds is recommended as has been described in EP-A's 0 620 483 and 0 726 491 as well as in RD 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$, more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable. Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/m$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned hereinbefore: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-Application No. 97201117, filed Apr. 15, 1997.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 530, trade name product marketed by Agfa-Gevaert.

New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertically oriented apparatus, it is important to avoid, or at least minimize leakage of treatment liquid from one vessel to another and carry-over as the sheet material passes through the apparatus. Furthermore it is desirable that the treatment liquid in one vessel is not contaminated by contents of the adjacent vessels, that is neither by the treatment liquid of the next higher vessel nor by vapours escaping from the next lower vessel. In order to reduce consumption of treatment liquids, it is furthermore desirable to reduce the evaporation, oxidation and carbonization thereof. A solution therefore has been proposed in EP-A 0 744 656, wherein it has been disclosed that contamination and evaporation, oxidation and carbonization can both be reduced in a simple manner by a particular construction of the apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip there-between through which the sheet material path extends and associated sealing means serving to provide a gas- and liquid-tight seal between the roller and reaction surface on the one hand and a wall of the housing on the other. According to a first aspect, invention is characterized by means for connecting each cell to adjacent cells in the stack in a closed manner and according to a second aspect, the invention is characterized in that the roller is a drive roller.

Particularly the objectives set forth above may be achieved when the developing cell of the apparatus is a closed cell and the developing liquid contains an ascorbic acid developing agent as has been described in EP-Application No. 96201753, filed Jun. 24, 1996. According to that invention, there is provided a method of processing photographic sheet material by use of an apparatus comprising a plurality of processing cells so arranged to define a sheet material path through the apparatus, at least one of the cells constituting a developing cell containing a developing liquid, characterized in that the developing cell is a closed cell and the developing liquid contains an ascorbic acid developing agent.

With respect to further characteristics of the processing apparatus we refer to EP-A 0 819 992, wherein it was an object to provide an apparatus in which operating components can easily be replaced without the need for substantial re-programming of the CPU. This could be achieved when information concerning characteristics of each operating component is stored in separate memory means.

A multi-component apparatus was thus provided comprising a plurality of operating components selected from output operating components, input operating components and combinations thereof, and a central processing unit operatively linked to said operating components, said central processing unit containing information concerning at least one desired operating sequence for said apparatus, characterized in that information concerning characteristics of each said operating component is stored in separate memory means. The programme which is typically carried in the CPU, is now seen as comprising two separable elements. Information concerning the desired function of the apparatus, i.e. logical data, such as the speed of sheet material through the apparatus, or the volume of liquid being pumped to vessels of the apparatus per unit time, continues to be stored in the CPU. Information concerning the characteristics of the operating components and their location, is separately stored for each operating component. The separate memory means is removable: when the service engineer removes a given operating component, he also removes the store of characteristics information pertaining to that operating component. As he replaces the removed operating component with a new one, he also provides a new information store, containing the characteristics information pertaining to the new operating component. The need for re-programming of the CPU is therefore avoided. The new information store is created off-site, for example as the new operating component is manufactured. In an alternative embodiment, the separate memory means is not removable, but is arranged to be by-passed or even re-programmed by the service engineer. Re-programming of the separate memory means is simpler than re-programming of the CPU. Improvements of that invention lie not only in the improved servicing characteristics but also in the quality assurance of replacement components.

As a rule a processing apparatus for photographic sheet material comprises several treatment cells, most or all of which are in the form of vessels containing a treatment liquid, such as a developer, a fixer or a rinse liquid. As used herein, the term "sheet material" includes not only photographic material in the form of cut sheets, but also in the form of a web unwound from a roll. The sheet material to be processed is transported along a sheet material path through these vessels in turn, by transport means such as one or more pairs of path-defining drive rollers, and thereafter optionally to a drying unit. The time spent by the sheet material in each vessel is determined by the transport speed and the dimensions of the vessel in the sheet feed path direction.

From time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevated temperature, is the usual cleaning liquid. Therefore it has ever been an object to provide an apparatus in which the path-defining rollers can be separated from each other in the open position, in a simple and convenient manner. The way in which this can be achieved has been described in WO 98/6005, wherein the path-defining rollers are supported by bearings carried by eccentric sleeves which are stationary in the closed position, and where means are provided for partly rotating the sleeves thereby to withdraw the path-defining rollers from each other into the open position. A sheet material processing apparatus has thus been provided, comprising at least one treatment cell, a pair of rotatable path-defining rollers defining a sheet material path through the cell, the path-defining rollers having a closed position in which the path-defining rollers are biased into contact with each other to form a nip through which the sheet material path extends and an open position in which the path-defining rollers are spaced from each other, characterized in that the path-defining rollers are supported by bearings carried by eccentric sleeves which are stationary in the closed position, and means are provided for partly rotating the sleeves thereby to withdraw the path-defining rollers from each other into the open position.

It is clear that within the scope of this disclosure any screen/film combination may be used, wherein said screen comprises at least luminescent monoclinic yttrium tantalate phosphors e.g. doped with niobium and gadolinium, optionally in combination with other suitable UV/blue light emitting phosphors and wherein said film comprises {111} tabular silver halide crystals rich in silver chloride spectrally sensitized with at least one or more azacyanine dyes in combination with a processing unit, the proviso that with minimum amounts of silver coated (total amount, expressed as an equivalent amount of silver nitrate of less than 7.5 g /$m^2$) a sufficient covering power is attained in the film in rapid ecological processing (with e.g. ascorbic acid and/or derivatives thereof as developing agent(s) in a hardener-free developer and an odor-free fixer, optionally free from aluminum ions, thereby reducing sludge; and replenishing amounts for developer and fixer as low as possible, i.e. from about 20 ml/$m^2$ up to at most 200 ml/$m^2$) and provided that an optimal relationship is attained between sensitometry and image quality, especially sharpness, thanks to low cross-over exposure, without residual color, thus providing a good image tone.

5. EXAMPLES

Exposure

Pairs of screens were arranged in the same type of cassette and between the screens and in contact therewith a duplitized (double-side silver halide emulsion coated) film was inserted. The X-ray exposure proceeded according to ISO/DP9236 with 77 median kVp X-rays.

As a pair of "comparative screens" (CS) the screens called "CX-BLUE-R4" or 'BLUE M2" having M' Y(Sr,Li) $TaO_4$:Nb were used (tradename product from Agfa-Gevaert).

As a pair of "inventive screens" (IS) the screens called "MYTA:Gd:Nb" were used. The screens were prepared as described hereinafter.

The phosphor coating compositions were prepared by intimately mixing the following components

| | |
|---|---|
| $YTaO_4$:Gd:Nb | 200 g |
| cellulose acetobutyrate (30% in 2-butanone) | 1.72 g |
| polyethyl acrylate (30% in ethyl acetate) | 15.46 g |
| ethyl acetate | 10.70 g |
| methyl glycol | 8.72 g |
| methoxypropanol | 26.7 g |
| dispersing agent DISPERSE AYD (trade name) | 1.02 g |

The compositions were doctor blade coated onto a subbed 200 μm thick pigmented polyethylene terephthalate supports.

By roll coater onto the dried phosphor-containing layer a cellulose acetobutyrate layer having a dry thickness of 10 μm was applied as protective layer. The total amount of phosphor coated was 50 mg/$cm^2$. The screen/film(s) combination(s) were used in a cassette, wherein the cassette was the same for each experimental film.

Films

Film materials comprising tabular {111} grains rich in chloride were the following.

Preparation of Silver Chloroiodide Tabular Grain Emulsion

The following solutions were prepared:

6 l of a dispersion medium (C) containing 480 mmoles of sodium chloride, 150 g of inert gelatin and 360 mg of adenine; temperature was established at 45° C., pH was adjusted to 6.0;

a 2.94 molar silver nitrate solution (A);

a solution containing 2.813 moles of sodium chloride, 14 mmoles of potassium iodide and 398.1 mg of adenin (B1).

A nucleation step was performed by introducing solution A and solution B1 simultaneously in dispersion medium C both at a flow rate of 120 ml/min during 30 seconds. After a physical ripening time of 20 min during which the temperature was raised to 70° C., the first growth step was performed by introducing by a double jet during 28 minutes and 50 seconds solution A starting at a flow rate of 10 ml/min and linearly increasing the flow rate to an end value of 27.4 ml/min, and solution B1 at an increasing flow rate in order to maintain a constant mV-value, measured by a silver electrode versus a saturated calomel electrode (S.C.E.), of +115 mV. At the end of the first growth step the flow rate of solution A was immediately decreased to 10 ml/min and the mV-value adjusted to +135 mV and increased again to a flow rate of 19.8 ml/min during the following 16 minutes and 8 seconds, during which time the mV-value was further held constant at +1135 mV by a controlled increasing flow of B1.

After a physical ripening time of 4 minutes a solution of 40 ml having 15 mmoles of potassium iodide was added at a constant flow rate of 2 minutes. The total iodide content of the tabular silver chloroiodide crystals was thereby enhanced to a value of up to 1.0 mole %.

After cooling to about 40° C. the addition of 56 ml of polystyrene sulphonic acid in 2 minutes was started, the pH value of the said dispersing medium was adjusted to a value of 3.5 with sulphuric acid and after cooling to 20° C. the obtained flocculate was decanted and washed three times with an amount of 4 l of demineralized water (11° C.) in order to remove the soluble salts present. After decanting to a volume of 2 l the washing procedure was repeated twice and after the last washing step, followed by sedimentation decantation was performed in order to have an emulsion volume as low as possible. An emulsion having {111} silver chloroiodide tabular grains with a variable iodide profile as in EP-A 0 678 772 was thus obtained.

The thus obtained silver chloride tabular emulsion showed the following grain characteristics:

an average equivalent circular diameter E.C.D. of 1.40 μm;

an average thickness t of 0.14 μm;

an average aspect ratio AR of 10.0.

These data were obtained from electron microscopic photographs: the diameter of the grain was defined as the diameter of the circle having an area equal to the projected area of the grain as viewed in the said photographs.

Before the start of the chemical ripening the mV-value of the emulsion was adjusted at +158 mV (against a silver/silver chloride reference electrode) with sodium chloride and the pH-value at 5.5 with sodium hydroxide. Chemical ripening agents were adapted to the crystal size of the emulsions.

Chemical ripening agents were gold thiocyanate, sodium thiosulphate as a source of sulphur and toluene thiosulphonic acid was used as predigestion agent. The amounts of each chemical ripening agent were optimized in order to obtain an optimal fog-sensitivity relationship after 2 hours at 70° C., without the presence of bromide ions, opposite to the required use thereof at a temperature of greater than 80° C. as in U.S. Pat. No. 5,494,788.

Preparation of the Film Material

Before coating each emulsion was stabilized with 1-p-carboxy-phenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 μm.

The resulting photographic material contained per side an amount of silver halide corresponding to 3.5 grams of $AgNO_3$ per $m^2$ and an amount of gelatin corresponding to 2.8 g/$m^2$.

in the film TC (comparative) spectral sensitization of the said tabular emulsion crystals rich in silver chloride were performed with oxacarbocyanine sensitizer anhydro-5,5'-dichloro-3,3'-bis-(n.sulphopropyl)-9-ethyloxacarbocyanine hydroxide;

in the film TI (inventive example) spectral sensitisation was performed with the benzothiazine azacyanine compound (II.10) said forth above in the detailed description.

Film materials comprising cubic {100} silver chloride grains having an average grain size of 0.45 μm were prepared as follows:

Cubic Silver Chloride Emulsion

A silver chloride emulsion was prepared by a double jet technique. Therefore an amount of 880 ml of demineralized water was used as starting volume in the vessel, containing further 46 g of inert gelatin and 7 mmoles of sodium chloride at 60° C. The mixture was rotated at a rate of 500 r.p.m.

From a diluted silver nitrate solution (0.3 N) 0.44 ml was added to the vessel and in order to get a UAg (in mV vs. silver/silver chloride reference electrode) of +138 mV+2 mV about 1 ml of sodium chloride 3 N was added.

Concentrated solutions of 1 l of $AgNO_3$ and NaCl, 3 N each, were run with the double jet technique at a rate of 3 ml per minute for the silver nitrate solution and the sodium chloride solution during 5 minutes. After this first step, the addition rate was linearly increased up to a rate of 30 ml/min. during 59 minutes and 42 seconds for the silver nitrate solution. The sodium chloride solution was also added at an increasing rate rate, but the addition rate was increased in order to get a constant UAg-value of +138 mV ±2 mV throughout the whole growth step.

At the end of the precipitation the flocculation procedure could begin: pH was adjusted at a value of 3.3 with sulphuric acid, 3 M, and 4.5 g of polystyrene sulphonic acid was added slowly in 2 minutes. The washing procedure was performed in a discontinous way, adding 3 l of demineralized water, containing up to 8 mmole of sodium chloride pro liter, until pAg was reaching a value of about 100 mV. After addition of inert gelatin to a ratio of gelatin to silver nitrate in the emulsion of about 0.5, the emulsion was peptized and was chemically ripened to an optimal fog-sensitivity relationship at 52° C., pAg having a value of about 125 mV.

Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 4 mg and 8.6 mmoles respectively.

2. Coating Compositions.

A photographic material was prepared having on a subbed polyester base the gelatinous cubic silver chloride emulsion having an average grain size of 0.45 mm the preparation of which has been described above.

The emulsion was further stabilized with 0.22 mmole of compound (V) and 0.68 mmole of compound (VI) per mole of silver nitrate.

(V)

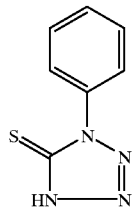

(VI)

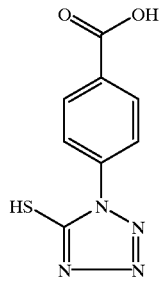

The sodium salts of 7-sulpho-naphto-[2,3-D]-oxazoline-2-thion and 1-phenyl-5-mercaptotetrazole were added as stabilizers in amounts of 40, respectively 30 mg per 100 g of $AgNO_3$.

A coated amount of silver expressed as the equivalent amount of silver nitrate of 4.0 g per square meter and a gelatin to silver chloride ratio (expressed in equivalent amount of silver nitrate) of 0.35 was provided with a gelatin covering layer (antistress layer) of 1.30 g of gelatin per $m^2$. in the film CI (inventive example) spectral sensitization was performed with the benzothiazine azacyanine compound (X) said forth above in the detailed description. The said compound was added in an amount of 0.5 mmole per mole of silver.

The processing was run in the developing liquid INVDEV, followed by fixing in fixing liquid INVFIX and rinsing at the indicated temperature of 35° C. for a total processing time of 45 seconds.

Processing of all film materials occurred in a developer, the composition of which has been given hereinafter.

| Developer INVDEV | |
|---|---|
| 1-phenyl-4-methyl-4'hydroxy-methyl-pyrazolidine-3-one | 2 g/l |
| Sodium EDTA | 2 g/l |
| Potassium bromide | 3.3 g/l |
| Potassium thiocyanate | 1 g/l |
| Potassium sulphite | 33 g/l |
| Potassium carbonate | 96 g/l |
| Polyglycol (M.W. = ca. 400) | 20 ml/l |
| Compound (4) | 1 g/l |
| Ascorbic Acid | 50 g/l |
| pH ready-for-use | 10.0 |

The developed samples were fixed in fixer INVFIX, followed by rinsing with water. The composition of the said fixer was as follows:

| Fixer INVFIX | |
|---|---|
| Ammonium thiosulphate (60% solution, wherein 1 ml comprises 0.778 g) | 710 ml |
| Sodium metabisulphite | 80 g |
| Sodium acetate | 130 g |
| Acetic acid | 31 ml |
| pH ready-for-use (after dilution 1 + 3) | 4.90 |

Sensitometric data are expressed for

"fog" levels F, determined as the sum of support density and density due to real emulsion fog, speed values S, determined at a density of 1.0 above fog level, wherein said values are multiplied by a factor of 100.

The determination of the photographic speed S of said screens proceeded according to the International Standard method ISO/DP9236 (42N2063) Revised edition of November 1986 and are given in the Table as 1000/$\mu$Gy for a density of 1.00 above fog as set forth hereinbefore.

gradation levels GG, wherein differences are expressed as a procentual figure: GG-gradation values are determined between a density of 1.0 and 3.0 above fog level.

In Table 1 results are summarized for the different film materials after exposure and processing as set forth above. Coated amounts of silver, expressed as an equivalent amount of silver nitrate are given further, as well as cross-over %, determined in the following way: samples of the materials were placed between a single blue light emitting screen (BLUE R4: CS for the comparative screen and the "inventive screen" IS respectively, according to the combination made) and a white paper, replacing the second screen. This film-screen element, directed with its light emitting screen to the X-ray tube, was then exposed with varying X-ray doses, expressed as log E. After processing these samples in the above described processing cycle, the minimal dose (log E) needed to obtain a density of 0.5 above fog was determined for the front layer (log E front) and the back layer (log E back) separately. The cross-over (% C.O.) was then calculated according to the following equation:

$$\% \text{ CO}=100/\text{antilog (logE back}-\text{logE front)}$$

Values of covering power are also included: covering power was determed as ratio of maximum density (×100) to developed silver amount (in g/$m^2$) in the region of the said maximum density.

TABLE 1

| FILM | SCREEN | COAT | F | S | GG | CO | CP |
|---|---|---|---|---|---|---|---|
| CPB-U | M2 | 7.20 | 0.200 | 31 | 254 | 38.0 | 52 |
| TI | CS | 8.29 | 0.270 | 17 | 392 | 43.0 | 49 |
| CC | CS | 7.63 | 0.203 | 9 | 187 | 44.3 | 41 |
| CI | CS | 7.63 | 0.390 | 9 | 201 | 44.4 | 42 |
| TI | IS | 8.29 | 0.280 | 29 | 383 | 18.6 | 54 |
| CC | IS | 7.63 | 0.202 | 22 | 197 | 21.9 | 43 |
| CI | IS | 7.63 | 0.380 | 20 | 202 | 20.5 | 43 |

As becomes clear from the data given in Table 1 it is possible to reach the required speed with an at least comparable (and even higher) covering power but a remarkably better cross-over (lowering from 38.0% to 18.6% which results in better image quality) when use is made of a film/screen combination wherein the film material is coated from a {111} tabular grain emulsion rich in chloride and wherein the said grains have been spectrally sensitized with an azacyanine dye as given hereinbefore, instead of the comparative example wherein a {111} tabular silver bromoiodide grain emulsion has been coated in a film in combination with a comparative screens having M' Y(Sr,Li) $TaO_4$:Nb phosphor particles.

Said comparative screens in combination with film materials rich in silver chloride don't provide the desired speed, opposite to screens having M YTa:Gd:Nb phosphors.

It has further been made clear that satisfactory results cannot be attained when use is made of cubic crystals as there is lack for speed, higher cross-over percentage if compared with {111} tabular grains rich in chloride and too low covering power and gradation.

In the presence of the monomethine azacyanine dyes residual color was observed for none of the materials comprising said dyes, even not at very low replenishing rates of 100 ml/$m^2$ and even lower.

We claim:

1. A radiographic screen/film combination comprising a duplitized film sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the wavelength range shorter than 380 nm, ii) said film comprises {111} tabular silver halide grains rich in silver chloride, spectrally sensitive to irradiation in the said wavelength range shorter than 380 nm by the presence of at least one azacyanine dye as a spectral sensitizer.

2. Radiographic screen-film combination according to claim 1, wherein said pair of intensifying screens essentially consists of luminescent phosphor particles emitting at least 80% of their emitted radiation in the wavelength range shorter than 380 nm.

3. Radiographic screen-film combination according to claim 1, wherein phosphor particles are niobium and gadolinium doped, monoclinic M, yttriumtantalate phosphor particles corresponding to formula I:

$$YTaO_4:Gd:Nb \quad (I).$$

4. Radiographic screen-film combination according to claim 1, wherein said azacyanine dye corresponds to the formulae (II.1) or (II.2)

(II.1)

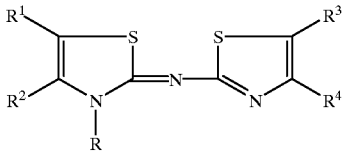

(II.2)

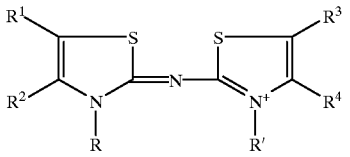

wherein each of the substituents $R^1$–$R^4$ independently represents hydrogen, an alkyl, an aryl or an aralkyl;

wherein $R^1$ and $R^2$ and/or $R^3$ and $R^4$ may form a benzoring, which, if substituted, has the same or different substituent (s) as $R^1$–$R^4$;

wherein R represents an alkyl, aryl or aralkyl group;

wherein R' represents hydrogen, an alkyl, aryl or aralkyl group;

and wherein cations and/or anions are present as charge compensating ions.

5. Radiographic screen-film combination according to claim 4, wherein each of R and R' independently represents $(CH_2)_nH$ or $(CH_2)_nOH$, n being an integer having a value from 1 to 4, $(CH_2)_m(SO_3^-)$, m being an integer having a value from 2 to 4, $(CH_2)_2CH(CH_3)(SO_3^-)$, $(CH_2)_n(COO^-)$ or $(CH_2)_n(COOH)$, $(CH_2)_nCONHSO_2R$ or $(CH_2)_nCONHSO_2R'$.

6. Radiographic screen-film combination according to claim 4, wherein charge compensating cations are $Li^+$, $Na^+$, $Na^+$, $K^+$, $HN^+Et_3$, wherein Et represents ethyl.

7. Radiographic screen-film combination according to claim 4, wherein charge compensating anions are $Cl^-$, $Br^-$, $I^-$, $CF_3SO_3^-$, $^-$OTos or $^-$OMes, wherein $^-$OTos represents tosylate and $^-$OMes represents mesylate.

8. Radiographic screen-film combination according to claim 1, wherein said film comprises {111} tabular silver halide grains rich in silver chloride having an average aspect ratio of 5 or more, an average grain thickness of at most 0.2 μm, and account for at least 50% of the total projective area of all grains.

9. Radiographic screen-film combination according to claim 1, wherein said film comprises {111} tabular silver halide grains rich in silver chloride having an average aspect ratio of from 8 to 20, an average grain thickness of from 0.06 μm to 0.2 μm, and account for at least 70% of the total projective area of all grains.

10. Radiographic screen-film combination according to claim 1, wherein the total amount of coated silver halide in said film, expressed as an equivalent amount of silver nitrate, is less than 7.5 $g/m^2$.

* * * * *